US007040729B2

(12) United States Patent
Richards

(10) Patent No.: US 7,040,729 B2
(45) Date of Patent: May 9, 2006

(54) SYSTEMS, METHODS, AND DEVICES FOR CONTROLLING INK DELIVERY TO PRINT HEADS

(75) Inventor: David B. Richards, Fremont, CA (US)

(73) Assignee: Oce Display Graphics Systems, Inc., San Jose, CA (US)

( * ) Notice: Subject to any disclaimer, the term of this patent is extended or adjusted under 35 U.S.C. 154(b) by 0 days.

(21) Appl. No.: 10/778,728

(22) Filed: Feb. 13, 2004

(65) Prior Publication Data

US 2005/0146545 A1 Jul. 7, 2005

Related U.S. Application Data

(63) Continuation-in-part of application No. 10/164,442, filed on Jun. 6, 2002, now Pat. No. 6,705,711.

(51) Int. Cl.
*B41J 2/195* (2006.01)

(52) U.S. Cl. ..... 347/7; 347/19

(58) Field of Classification Search ..... 347/5–7, 347/14, 17, 19, 84–87
See application file for complete search history.

(56) References Cited

U.S. PATENT DOCUMENTS

| | | | | |
|---|---|---|---|---|
| 3,790,703 A | | 2/1974 | Carley | |
| 3,929,071 A | | 12/1975 | Cialone et al. | |
| 4,079,384 A | | 3/1978 | Takano et al. | |
| 4,084,165 A | | 4/1978 | Skafvenstedt et al. | |
| 4,089,007 A | | 5/1978 | Perry et al. | |
| 4,270,133 A | | 5/1981 | Shimazawa et al. | |
| 4,336,547 A | | 6/1982 | Matsumoto et al. | 347/85 |
| 4,346,388 A | | 8/1982 | Wiley | |
| 4,394,663 A | | 7/1983 | Ameyama | |
| 4,719,472 A | | 1/1988 | Arakawa | |
| 4,827,278 A | * | 5/1989 | Lecheheb | 347/7 |
| 5,606,349 A | | 2/1997 | Droit et al. | |
| 5,782,184 A | | 7/1998 | Albertalli et al. | |
| 5,880,748 A | * | 3/1999 | Childers et al. | 347/85 |
| 5,988,802 A | | 11/1999 | Pawlowski, Jr. et al. | |
| 5,992,986 A | | 11/1999 | Gyotoku et al. | |
| 5,997,124 A | | 12/1999 | Capps et al. | |

(Continued)

FOREIGN PATENT DOCUMENTS

JP 2003 341028 A 12/2003

(Continued)

OTHER PUBLICATIONS

English Translation of Abstract form Publication No. JP 2003 341028A (Konica Minolta) Published Dec. 3, 2003.

*Primary Examiner*—Juanita D. Stephens
(74) *Attorney, Agent, or Firm*—Workman Nydegger

(57) ABSTRACT

Systems and methods for delivering ink by controlling a pressure of the ink. A vacuum or partial vacuum is maintained at an ink reservoir that supplies ink to one or more print heads. As the temperature of the inks or of the printing system changes, the pressure of the ink experiences a corresponding change. The printing system is equipped with temperature sensors to detect the temperature of the ink, the print heads, or the printing system. The temperature data is processed and an adjustment is made to the partial vacuum maintained on the ink reservoir to accommodate changes in temperature. The temperatures are repeatedly sampled to ensure that the pressure of the partial vacuum is properly maintained for current temperatures.

34 Claims, 5 Drawing Sheets

U.S. PATENT DOCUMENTS

| | | | | |
|---|---|---|---|---|
| 6,142,613 | A | 11/2000 | Asakawa et al. | 347/65 |
| 6,145,949 | A | 11/2000 | Takahashi | 347/14 |
| 6,168,252 | B1 | 1/2001 | Yaji | |
| 6,227,641 | B1 * | 5/2001 | Nishikori et al. | 347/17 |
| 6,302,516 | B1 | 10/2001 | Brooks et al. | |
| 6,305,786 | B1 | 10/2001 | Plotkin et al. | |
| 6,318,833 | B1 | 11/2001 | Lyman et al. | |
| 6,318,851 | B1 | 11/2001 | Hoen et al. | |
| 6,328,399 | B1 | 12/2001 | Wen | |
| 6,331,052 | B1 | 12/2001 | Murai et al. | |
| 6,698,869 | B1 * | 3/2004 | Vosahlo | 347/85 |

FOREIGN PATENT DOCUMENTS

| | | |
|---|---|---|
| WO | WO 03/103974 | 12/2003 |

* cited by examiner

SYSTEMS, METHODS, AND DEVICES FOR CONTROLLING INK DELIVERY TO PRINT HEADS

CROSS-REFERENCE TO RELATED APPLICATIONS

This application is a continuation-in-part of Ser. No. 10/164,442 now U.S. Pat. No. 6,705,711, filed Jun. 6, 2002, and entitled METHODS, SYSTEMS, AND DEVICES FOR CONTROLLING INK DELIVERY TO ONE OR MORE PRINT HEADS, which is hereby incorporated by reference in its entirety.

BACKGROUND OF THE INVENTION

1. The Field of the Invention

The present invention relates to systems and methods for controlling ink delivery to print heads in a printing system. More particularly, the present invention relates to systems and methods for adjusting a pressure of ink at the nozzles of the print heads using temperature data of the printing system.

2. The Relevant Technology

Printing systems, such as ink-jet printing systems, are well known devices and are available from various manufacturers. A typical ink-jet printing system includes multiple print heads mounted on a movable carriage. Each print head usually has multiple nozzles through which ink is delivered during a printing process. As the carriage moves back and forth across a media, ink is deposited on the media by the nozzles of the print heads at appropriate times and at precise locations. In typical color printing processes, there is a print head for each color and each color may be deposited on the media during each pass of the print head.

The nozzles on each print head must be controlled to deposit ink drops in precise locations. The relative placement of ink drops of different colors is also controlled by the printing system. As the ink drops are ejected from the nozzles and placed on the media, it is often desirable to ensure that all of the deposited ink drops have the same volume. Of course, there are instances where different amounts of ink may be deposited in a given process. However, the amount of ink deposited on a media during a printing process can have an impact on the quality of the image. Excessive ink may result in smearing or ink running on the media, thereby reducing the image quality, while insufficient amounts of ink may result in a poor image or visible lines in the image.

Part of the problem in delivering a proper volume of ink to a media is related to the nozzle itself and to the meniscus of ink associated with each nozzle. Each nozzle of a print head is associated with its own meniscus and when the meniscus extends beyond its own boundaries and encroaches on the meniscus of a neighboring nozzle, the meniscuses merge. When this occurs, the amount of ink delivered to the media can no longer be effectively controlled and excessive ink is often delivered to the media. When the meniscuses merge, the ink can also solidify on the print head and prevent ink from being deposited by the affected nozzles. The amount of ink delivered to the media is reduced in this case and the quality of the printed image is again reduced.

Furthermore, when a curvature of the meniscus exceeds certain limits governed by the surface tension characteristics of the ink and the adhesion of the ink to the nozzle, the meniscus can break. When the meniscus breaks, ink "drools" from the nozzle before, during, and after a printing process and reduces the quality of the printed image. In addition, the quality of the printed image can also be affected when the meniscus becomes concave and extends inwardly through the nozzle and into the print head. When this occurs, insufficient ink is delivered to the media.

Many attempts have been made to control the volume of ink deposited from the print nozzles. Further, many attempts have been made to control the curvature of the meniscus of the ink at the nozzles to prevent insufficient or excessive amounts of ink from being deposited upon printable media during a printing process.

In numerous ink-jet printers, ink is delivered to each print head by a tube that connects the print head to an ink reservoir positioned above the vertical level of the print head. During the printing process, ink flows along the tube to the nozzle of the print head under the force of gravity as the weight of the ink within the ink reservoir forces the ink stored in the tubing toward the nozzles. The volume of ink forced to each nozzle depends upon the particular volume of ink stored in the ink reservoir, fluid dynamic characteristics of the tubing, and chemical characteristics or properties of the ink. For instance, when an ink having a high absolute viscosity is employed with a printing device, a low volume of ink is forced to a nozzle under a given pressure. Similarly, when an ink having a low absolute viscosity is employed with a printing device, a high volume of ink is forced to a nozzle under the same given pressure. Changes to the chemical composition of the ink causes changes in the effectiveness of these gravity-type ink-jet printers. These types of ink-jet printers are difficult to use with a variety of different inks because of the effect that the given pressure has on the volume of ink deposited on the media.

Other ink jet printers utilize a surge suppressor to pressurize the ink as it is passed into the ink reservoir. The surge suppressor maintains an average pressure within the tube connecting the ink reservoir with the print head. Typically, the surge suppressor used in such ink-jet printers is designed for a particular ink, with associated characteristics and properties. Additionally, surge suppressors are typically not adjustable and allow large ranges of pressure fluctuations.

The ability to deliver a volume of ink through a nozzle is also affected by the temperature of the ink and of the printing system. The temperature of a print head can increase quickly when printing and change the temperature of the ink, which has an effect on the viscosity of the ink. The printing system can also generate heat that has an impact on the pressure of the ink. The curing units of ultraviolet (UV) ink-jet printers or the infrared (IR) units of other ink-jet printers, for example, can generate significant amounts of heat that can adversely affect the volume of ink delivered to a media by altering the viscosity of the ink. Because the viscosity of the ink changes with temperature, the pressure applied to the ink is no longer correct and may result in excessive or insufficient quantities of ink being delivered through the nozzles of the print heads.

Changes in the viscosity of the ink due to temperature can have an impact on the quality of the printed image. The change in viscosity means that the pressure applied to the ink is no longer correct and may cause a meniscus to rupture or to merge with other meniscuses. In each case the quality of the printed image is reduced. Existing systems do not adjust the pressure of the ink relative to the current temperature. It would be an advance in the art to provide systems and methods that maintain high quality image reproduction through control of the volume of ink deposited from a nozzle of a print head and more particularly to systems and methods for controlling the pressure of ink relative to at least the temperature of the ink or of the printing system.

BRIEF SUMMARY OF THE INVENTION

These and other limitations are overcome by embodiments of the present invention, which is generally related to systems and methods for controlling delivery of ink in print heads and more specifically to controlling a pressure of the ink at nozzles of the print head using temperature of the ink or of the printing system.

In one embodiment of the invention, a vacuum pump is used to control the pressure of an ink reservoir that supplies ink to a print head. The pressure of the ink at the nozzles of the print head is thus controlled by altering the pressure at the ink reservoir. As ink is deposited on a media, the temperature of the print heads and of the ink typically increases. The change in the temperature of the ink affects the viscosity of the ink. As a result, a different pressure is typically required for the ink.

In one embodiment, the temperature of the print head is sensed using a temperature sensor. A controller uses the temperature data to adjust the pressure of the inks at the nozzles by changing the pressure at the ink reservoir. The controller can use just the data supplied by the temperature sensor(s) connected with the print head(s). Alternatively, the controller can use temperature data from a temperature sensor placed in the environment of the printing system in combination with temperature data from the sensor(s) on the print head(s). In this case, the temperature data may be averaged, for example, to account for the temperature of ink at the print heads that do not fire or do not fire as often as other print heads.

After the temperature data is obtained, the controller processes the temperature data to identify an appropriate pressure. The desired pressure may be stored in a look up table that is accessed according to the temperature data. After the appropriate pressure for the current temperature data is identified, the controller causes the vacuum pump and/or accumulator to adjust the pressure of the ink accordingly. This ensures that the pressure of the ink at the nozzles of the print head(s) is within an appropriate range to ensure that the volume of ink delivered through the nozzle is optimized.

The look up tables may be determined empirically. The look up tables associate a temperature with a pressure. Look up tables can be included for different types of ink as well as different printing modes. For example, the controller may access the look up table that is associated with a particular type of ink and/or pass mode to identify an appropriate pressure. Look up tables may also be stored for each color of ink. Also, information from other sensors may be accounted for when identifying a pressure. The level of ink in the reservoir, the current pressure, and the like are examples of other sensor data that may be used to identify an appropriate pressure.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
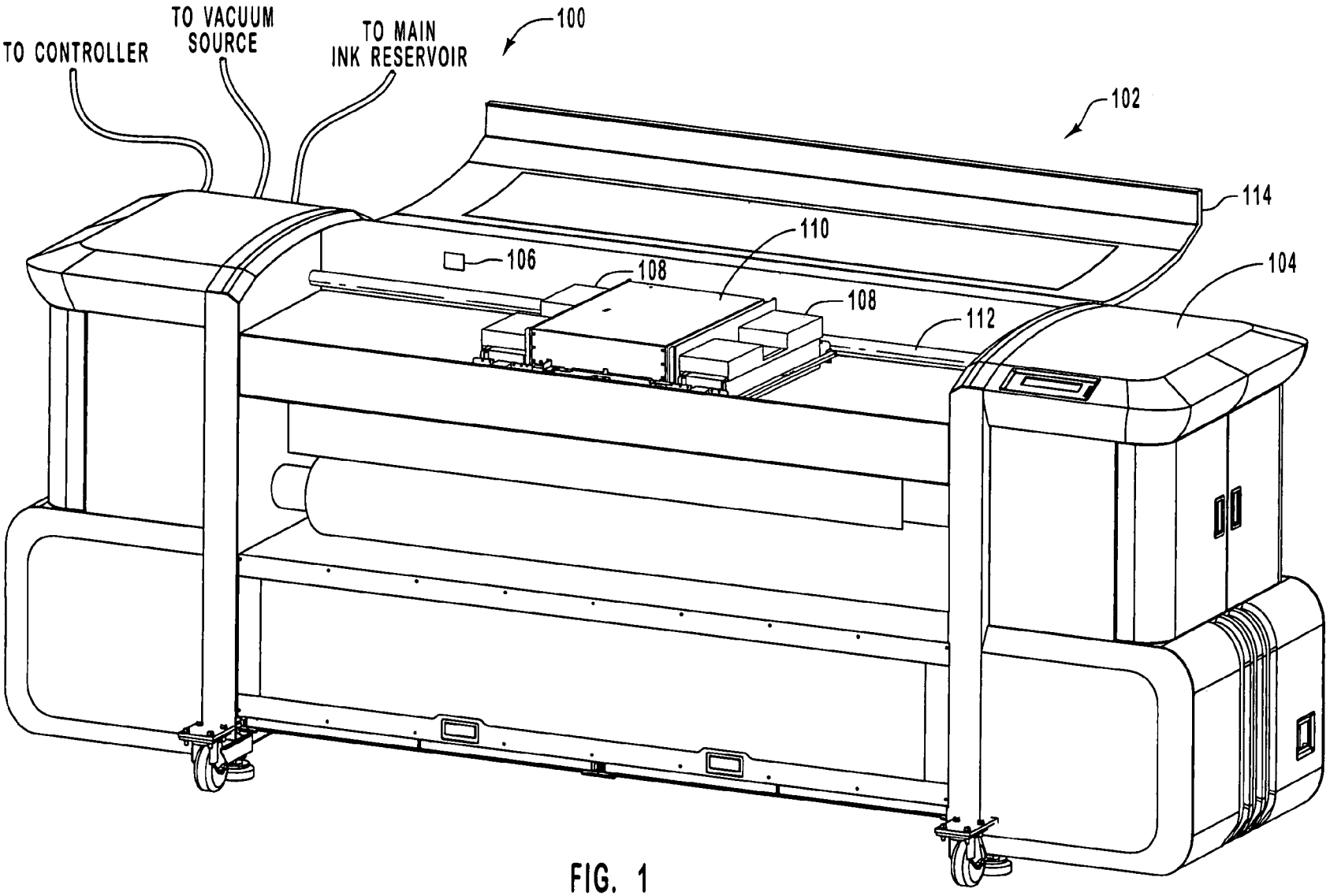
FIG. 1 illustrates one example of a printing systems for implementing embodiments of the present invention.

The present invention relates to systems, methods and apparatus for delivering ink to one or more print heads and more particularly to maintaining or controlling an appropriate pressure of the ink at the nozzles of the print heads. By maintaining an appropriate pressure of ink at the nozzles, a desired volume of ink is delivered to the media. Embodiments of this invention facilitate ink delivery to nozzles of the print heads while controlling the pressure of the ink, relative to the changing viscosity of the ink, at the nozzles within defined tolerances. Controlling the pressure of the ink within defined tolerances provides a mechanism for correctly delivering a volume of ink and limits the potential for depositing excessive or insufficient quantities of ink upon printable media.

When the temperature of ink changes in a print head, the viscosity of the ink changes. The pressure required to deliver an appropriate volume of ink varies at least with respect to the temperature of the ink or to the viscosity of the ink. In other words, a change in temperature may require a change in the pressure that is associated with the ink. The required pressure of the ink can therefore be affected by the temperature of the ink and embodiments of the invention are directed to controlling the required pressure in response to at least the temperature of the ink, the print heads, the printing system, and the like or any combination thereof.

When a printing system begins a printing process, the printing system is typically cold, not having been operating for some period of time. As a result, the appropriate pressure required to deliver a proper volume of ink is at a certain level. During the printing process, firing print heads generate heat that can change the viscosity of the inks. Because the viscosity of the ink(s) has changed, a different pressure is required at the nozzles of the print heads. The printing system itself also generates heat that can change the viscosity of the ink, which may require a different pressure. In both cases, a change in pressure, which is related to the change in the viscosity of the ink, may be necessary to prevent excessive or insufficient quantities of ink being delivered to the media. Embodiments of the invention sample the temperature of the print heads and/or the printing environment and then adjust the pressure of the inks to compensate for the new temperatures. In other words, embodiments of the invention control the pressure of the inks in response to changes in the viscosity and/or temperature of the inks.

According to another aspect of one embodiment of the present invention, a vacuum or partial vacuum is created within an ink reservoir that stores the ink to be delivered from a print head. As used herein, the terms "vacuum" and "partial vacuum" refer to a pressure that is lower than ambient pressure or atmospheric pressure for a particular geographic location of the print system or device of the present invention. The terms "vacuum" and "partial vacuum" are used interchangeably to refer to pressures below or deviation from ambient pressure or atmospheric pressure.

The vacuum or partial vacuum aids with controlling a pressure exerted by the ink at the nozzles of the print head(s). The level of the vacuum or partial vacuum within the ink reservoir can be changed to control the pressure of the ink at the nozzles of the print head(s). The level of the vacuum or partial vacuum within the ink reservoir can also be adjusted using an ambient temperature of the printing system, ink temperatures, and/or print head temperatures. By so doing, embodiments of the present invention provide a mechanism to control the volume of ink delivered through the nozzles of the print head and maintain the operability of the print head.

By providing control of the vacuum or partial vacuum level within the reservoir, an embodiment of the present invention provides systems, methods, and apparatus that can accommodate a variety of inks having differing characteristics and properties without the need for significant expense and time associated with testing of the particular system or device for each particular ink. Further, control of the vacuum or partial vacuum level provides a mechanism to control the size, shape, and configuration of a meniscus of the ink formed at one or more nozzles of one or more print heads. Changes to the curvature of the meniscus can control the volume of ink discharged from the nozzles of the print head during a printing process.

The following discussion of illustrative systems, methods, and apparatus of the present invention will be directed to large format printing systems and devices. One skilled in the art, however, can appreciate that the teachings of the present invention can be utilized in various other types of printing systems or devices, ranging from small home use printers or systems to other large commercial printers or systems. Further, although reference is made to the use of ink, it can be understood that structures and functions of the present invention can be used in any situation where a pressure of a fluid is controlled by varying a level of a vacuum or partial vacuum within a container storing the particular fluid. The fluid with the container can be in a liquid or gaseous state.

Ambient temperature typically refers to the area surrounding the printer carriage. This area can have elevated temperatures, especially if airflow to the area surrounding the printer carriage is suppressed. The elevated temperatures in this area are usually the result of the operation of the print heads. Much of the heat can also be attributed to ultraviolet (UV) curing sources in UV ink-jet printing systems, to the infrared (IR) sources in IR ink-jet printing systems, or other sources of heat.

Referring now to FIG. 1, depicted is an exemplary configuration of one printing system of the present invention. The printing system 100 includes a printing device 102 that is connected with a main ink reservoir, a controller, and a vacuum source (not shown). The main ink reservoir, controller, and vacuum source, however, can be integrated with the printing system 100. The printing system 100 is capable of delivering ink to a printable media. The inks can include, but are not limited to, an air-dry pigmented liquid, a heat dry pigmented liquid, an ultraviolet curable pigmented liquid, absorbable liquid, or other type of ink capable of being delivered by one or more print heads. In another configuration, printing system 100 is capable of delivering other fluids through associated print heads, such as but not limited to fluids for etching glass, metallic fluids to be deposited on a media, or any other fluid that may be deposited from a nozzle and receive a benefit from the teaching of the present invention.

Printing device 102 includes a housing 104 that retains various components and control mechanisms of printing device 102, only some of which will be described herein for ease of explanation of the present invention, while others will be understood by those skilled in the art in light of the teaching contained herein.

Disposed within housing 104 is a printer head carriage 110 that is movably mounted to a track 112 of printing device 102. The printer head carriage 110 moves back and forth along track 112 and allows delivery of ink from one or more print heads mounted to printer head carriage 110. Relative movement of printer head carriage 110 along track 112 can occur through various driving mechanisms. For instance, the driving mechanism can include, but not limited to, hydraulic or pneumatic driver mechanisms, mechanical driver mechanisms, chain or belt and driven sprocket mechanisms, combinations thereof, or other types of driving mechanism that are capable of performing the function of moving the printer head carriage along a track.

FIG. 1 also illustrates a lid 114 that can be opened to access the printer head carriage 110. In this embodiment, the printer head carriage 110 includes UV (or IR, etc.) sources 108. When the lid 114 is closed, the area surrounding the printer head carriage 110 is heated by the UV sources 108 as well as the print heads carried by the printer head carriage 110. The temperature sensor 106 may be mounted in this area to determine an ambient temperature of the printing device 102. It will be appreciated that the temperature sensor 106 can be mounted to other locations in order to determine the ambient temperature of the printing system.

Figure 2:
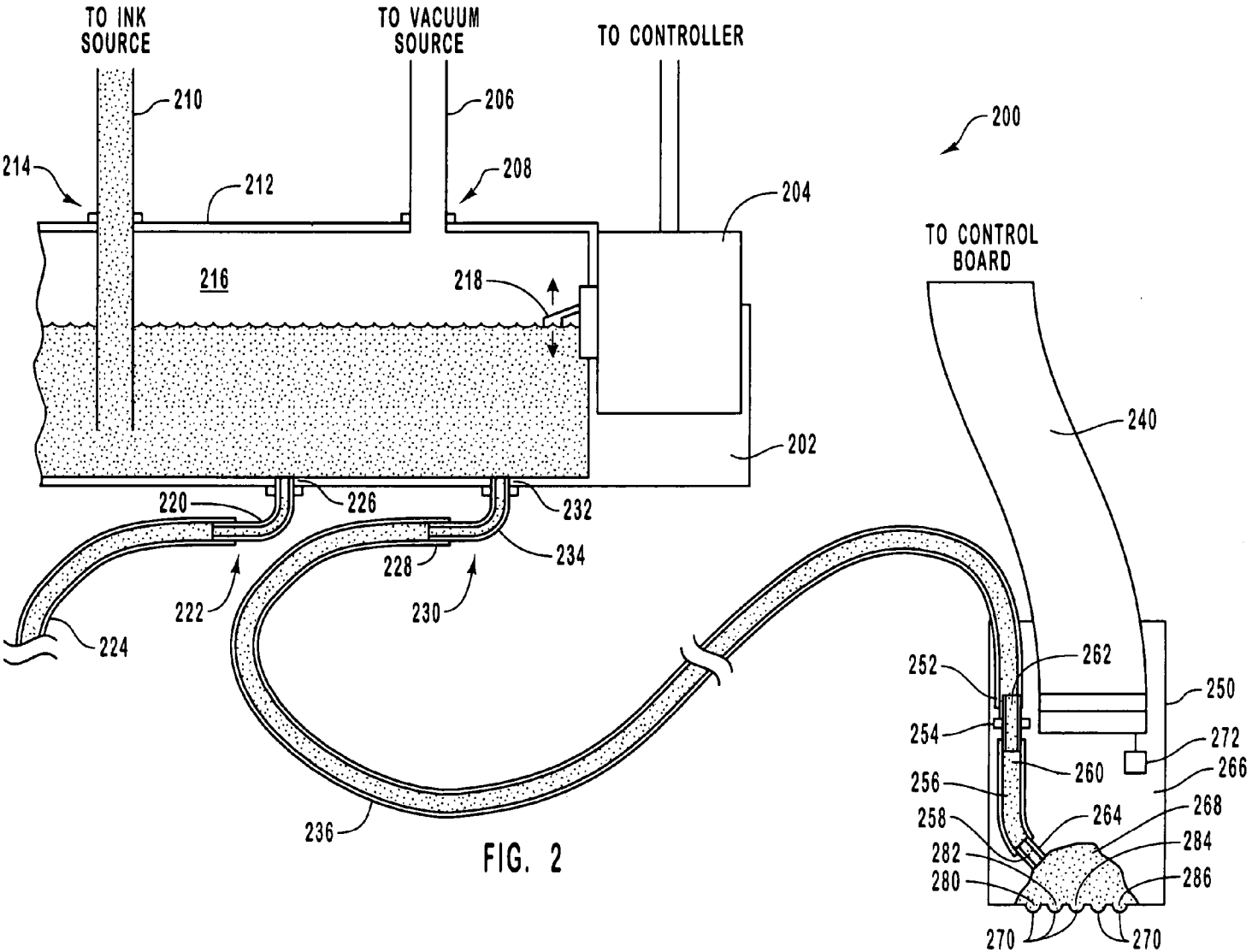
FIG. 2 illustrates a partial cross-sectional view of a print head connected with an ink reservoir that is pressurized by a vacuum source.

FIG. 2 illustrates a partial cross-sectional side view of an exemplary reservoir, print head, control board, and associated communicating tubes and ribbons forming part of the printer head carriage 110 of FIG. 1 in accordance with one embodiment of the invention. One of skill in the art can appreciate that a given printing system may have multiple printing heads, ink reservoirs, control boards, and associated tubes and ribbons.

More particularly, FIG. 2 illustrates a reservoir 212 that receives ink from a main ink source (not shown) through a tube 210. The reservoir 212 has a housing 202 that forms an interior space 216 that holds ink in this example. The sensor 218 detects a level of the ink in the interior space 216 of the reservoir 212. Signals from the sensor 218 are sent by the sensor device 204 to a controller that causes ink to be added to the reservoir 212 from the main ink source. The vacuum source (not shown) is used to maintain the vacuum or partial vacuum present in the reservoir 212.

The ink in the reservoir 212 flows through a tube 236 to a print head 250. The print head 250 receives electrical commands over the ribbon cable 240 that is used to control the nozzles that deposit ink on a media. The temperature sensor 272 senses a temperature of the print head 250 or more particularly of the ink in the print head 250. The sensor 272 may convey the temperature data via the ribbon cable 240 to a controller, which uses the temperature data to adjust the vacuum or partial vacuum in the reservoir 212. By adjusting the vacuum or partial vacuum in the reservoir 212, the pressure of the ink at the nozzles 280, 282, 284, and 286 (or nozzles 280–286) can be controlled.

As illustrated in FIG. 2, tube 236 connects to outlet 230. By connecting outlet 230 to tube 236, tube 236 provides a fluid pathway for the ink with interior space 218 of housing 202 and respective print head 250. In this exemplary configuration, a proximal end 228 of tube 236 connects to the outlet 230, while a distal end 252 of tube 236 connects to a print head 250. The tube 236 is an example of a structure capable of performing the function, whether alone or in combination with one or more of the structures described herein, of means for providing a fluid pathway between a reservoir and a print head. Other structures are known to those skilled in the art in light of the teaching contained herein.

In FIG. 2, tube 236 can have an inside diameter from about ¼ inch to about 1/32 inch. In another configuration, tube 236 has an inside diameter of about 3/32 inch. As with the number of ink outlets formed in reservoir 212, one or more tubes can be used with different configurations of the present invention. One of skill in the art can appreciate that the printer head carriage 110 shown in FIG. 1 may carry multiple print heads, ink reservoirs, and associated structure as illustrated in FIG. 2

Disposed at a distal end 252 of tube 236 is a print head 250. An exemplary print head 250 includes a body 266 that has an interior chamber 268. One or more nozzles 280–286 are disposed in body 266 that communicate with interior chamber 268. In this exemplary configuration, ink passes from tube 236, for example, to interior chamber 268 via lumens 262, 260, 258 associated respectively with a connector 254, an intermediate tube 256, and a port connector 264 of print head 250. These lumens 262, 260, 258 create a fluid pathway for the ink to traverse from reservoir 212 to interior chamber 268, before the ink is delivered from nozzles 280–286.

Although reference is made to specific lumens 262, 260, and 258 associated with connector 254, intermediate tube 256, and port connector 264 of print head 250, one skilled in the art can appreciate that various other configurations of the present invention are possible, so long as ink can traverse a fluid pathway from reservoir 212 to print head 250. More generally, the above-described lumens of the print head are structures capable of performing the function, whether alone or in combination with one or more of the structures described herein, of means for providing a fluid pathway between a reservoir and a print head. An alternate configuration, and hence alternate means for providing a fluid pathway, utilizes a single lumen extending from reservoir to print head 250 to form the desired fluid pathway. In still another configuration, multiple lumens form the fluid pathway from reservoir 212 to print head 250.

In addition to the above, lumens 262, 260, and 258 associated with connector 254, intermediate tube 256, and port connector 264 of print head 250 are examples of structure capable of performing the function of means for delivering a volume of a fluid to printable media during a printing process. Furthermore, the connectors permanently or releasably attached to the reservoir, the one or more print heads, and the tubes connecting the print heads to the reservoir are exemplary structures capable of performing the function of means for delivering a volume of a fluid to printable media during a printing process. In still another configuration, the control board and ribbon connector are included as exemplary structures capable of performing the function of means for delivering a volume of a fluid to printable media during a printing process. Other structure capable of assisting with or forming part of the means for delivering a volume of a fluid to printable media during a printing process are known to one skilled in the art in light of the teaching contained herein.

With continued reference to FIG. 2, generally, body 266 of print head 250 is adapted to securely retain circuitry and associated piezo-electric components used to deliver ink during a printing process. Although reference is made to print head 250 using piezo-electric components and technology to deliver ink during a printing process, one skilled in the art can identify various other components and technologies that are capable of delivering ink from the print heads, such as but not limited to, components associated with thermal printing technologies, electrical printing technologies, solid ink technologies, or other printing technologies known to those skilled in the art.

In addition to outlets 222, 230 that connect to apertures 226, 232 formed in the housing 202, reservoir 212 includes an ink inlet 214. The ink inlet 214 communicates with a remote main ink reservoir by a tube 210. The remote main ink reservoir contains a volume of ink that can be added to reservoir 212 as ink is delivered to print head 250 during a printing process. In this manner, ink extends continuously and completely between portions of reservoir 212, outlet 230, tube 236, and along the fluid pathway defined by lumens 262, 260, and 258 to interior chamber 268 and nozzles 280–286.

At nozzles 280–286, the ink from reservoir 212 forms a meniscus 270 or interface between the ink and nozzles 280–286. The curvature of meniscus 270 is controlled by the degree of attraction of the ink to the material forming nozzles 280–286 and the surface tension characteristics of the ink. Additionally, the curvature of meniscus 270 is affected by the pressure exerted by the ink above the vertical level of nozzles 280–286 because the pressure exerted by the ink at nozzles 280–286 is based upon the difference in vertical height between nozzles 280–286 and the vertical level of the ink within reservoir 212. In the event that the attraction of the ink to the material forming nozzles 280–286 is exceeded, the surface tension characteristics changed, or the pressure exceeds a certain level, the curvature of meniscus 270 will be changed so that meniscus 270 has a convex configuration and extends beyond the limits of nozzles 280–286. The extended meniscus can cause print head 250 to deliver a volume of ink greater than is needed during a printing process, resulting in excessive deposit of ink, incorrect mixing of inks, and poor image quality. In some instances, the extended meniscus will encroach upon the meniscuses of adjacent nozzles, thereby preventing the effective delivery of ink from one or more nozzles 280–286.

In the event that the pressure is lower than a certain level, there is a potential for ambient pressure to be sufficient to force meniscus 270 to have a concave configuration. Further, if the pressure is lower than a certain level, there is a potential for the ambient pressure to be sufficient to overcome the attraction or surface tension characteristics of the ink, resulting in meniscus 270 rupturing. In such a case, the ink can flow freely through the affected nozzle(s) and "drool" from the print head. The retracted or broken meniscus can cause print head 250 to deliver, respectively, either an insufficient volume of ink or a greater than needed volume of ink during a printing process. In these cases, incorrect mixing of inks and poor image quality occurs.

Maintaining the desired ink pressure is achieved by controlling the volume of ink in the ink reservoir within selected tolerances and/or adjusting the pressure based on temperature data obtained from the printing system. The tolerances associated with the volume of ink are based, for example, upon the particular ink and its associated characteristics and/or properties. By maintaining the level of ink within reservoir 212 within the proscribed tolerances, the pressure of the ink is maintained within desired tolerances and the correct volume of ink is delivered from the print heads during a printing process. Additionally, the pressure is sufficient to prevent rupturing of meniscus 270 and/or extending meniscus 270 beyond desired limits. The pressure of the ink may also be adjusted based on the temperature of the ink, the print heads, and/or the ambient temperature of the printing system.

The deviation from ambient pressure or atmospheric pressure of the pressure exerted by the ink at nozzles 280–286 can be from about −5 inches of water to about 20 inches of water, when measured at about 60° F. In another configuration, the deviation from ambient pressure or atmospheric pressure of the pressure exerted by the ink at nozzles 280–286 can be from about 3 inches of water to about 10 inches of water. In still another configuration, the deviation from ambient pressure or atmospheric pressure of the pressure exerted by the ink at nozzles 280–286 can be from about 6 inches of water to about 8 inches of water. In another configuration, pressure exerted by the ink at nozzles 280–286 can be substantially equal to ambient pressure or atmospheric pressure. The deviation from ambient pressure or atmospheric pressure can also be expressed in torr, PSI, and other pressure standards.

The delivery of the ink to the media can be affected by the pressure of the ink at the nozzles. The pressure of the ink can be affected by the placement of the ink reservoir relative to the ink head, the volume of ink in the reservoir, and the temperature of the ink. The temperature of the ink is one aspect that is likely to vary with time. For example, when a printing system is started, the print heads and the ambient temperature are cold or at a relatively low value compared to when temperatures that occur during operation of the printing system.

As the printing system proceeds with a printing process, the ambient temperature of the printing system increases and has an impact on the temperature of the inks, which impacts the viscosity of the inks at the nozzle. The change in viscosity requires a different pressure to properly deliver ink. In addition, firing the print heads also has an impact on the temperature of the inks and on the required pressure of the inks. Embodiments of the invention include adjusting the pressure of the ink at the nozzle, or of the ink system, to accommodate changes in temperature. Embodiments of the invention further contemplate adjusting the pressure of the ink at the nozzle, or of the ink system, to accommodate changes in temperature, ink level, chemical characteristics of the ink and the print heads/reservoirs, and the like or any combination thereof.

In this example, as shown in FIG. 2, the print head 250 is also connected with a temperature sensor 272, which may be used to collect temperature data to adjust the pressure. The temperature sensor 272 may be connected, for example, with a heat sink of the print head 250 or with another suitable component of the print head or printer head carriage. The temperature sensor 272 can be configured to determine the temperature of the print head 250 itself. Alternatively, the temperature sensor 272 can be mounted to sense the temperatures of the ink at the nozzles 280–286 or other suitable location. The sensor 272 can be calibrated such that the temperature of the ink and/or nozzles can be measured. In other words, the temperature measured at the heat sink of the print head 250 can be converted to a temperature of the ink, nozzles, and the like. The temperature sensed by the sensor 272 is conveyed, in this example, by the ribbon cable 240 to the controller of the printing system.

In a given printing system, temperature sensors can be placed in different configurations. The placement of the temperature sensors within the printing system may have an impact on how the temperature data is interpreted by the controller. For example, each print head of a printing system can be associated with a different temperature sensor. In another example, a temperature sensor may be associated with a group of nozzles on a print head and each print head may have multiple temperature sensors. In another example, a temperature sensor is associated with a single print head and is used in combination with another temperature sensor placed in the ambient of the printing system. Thus, the temperature sensors can be deployed within the printing system in various ways.

The temperatures sensed by the temperature sensors are used to adjust the pressure of the ink at the nozzles, thereby controlling the volume of ink deposited on a media and improving the quality of the printed images.

Figure 3:
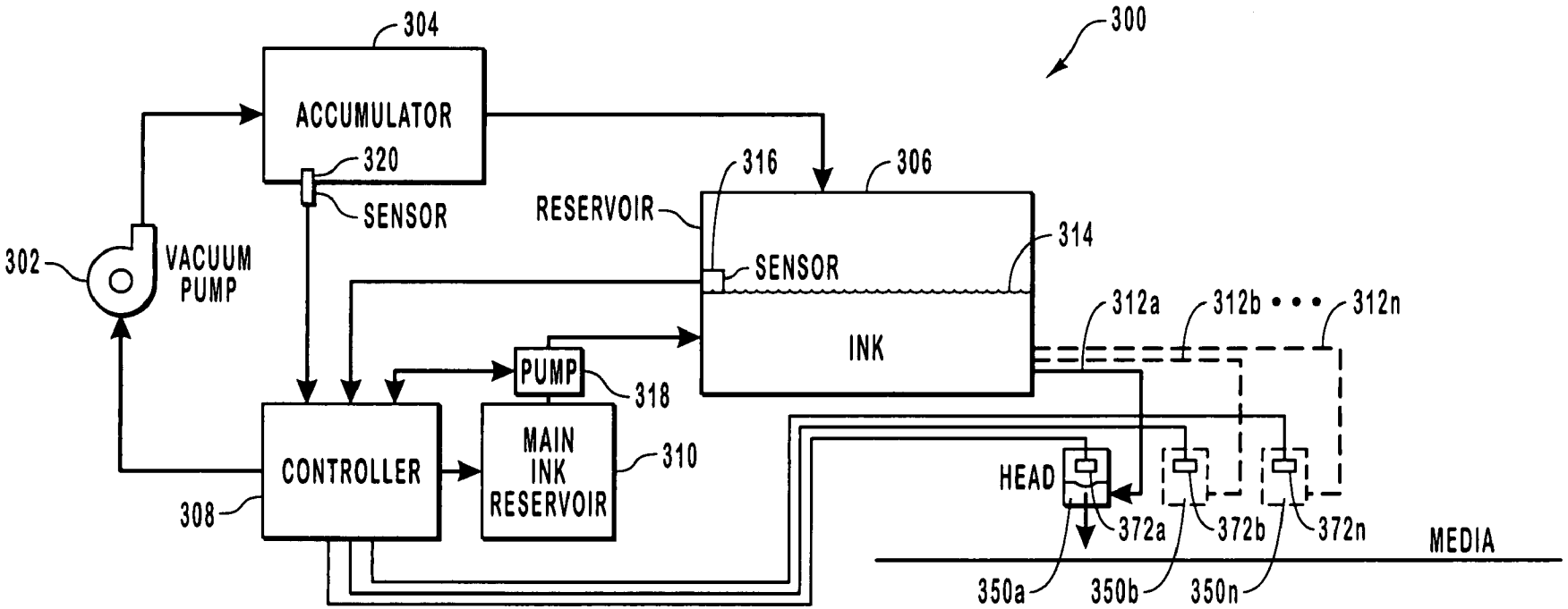
FIG. 3 is a schematic of one embodiment of a printing system that uses temperature sensors to adjust a pressure of the ink in the printing system.

To aid in maintaining the desired pressure based at least on the temperature of the ink or the printing system, housing 202 of reservoir 212 includes an inlet 208, shown in FIG. 2, which communicates with a vacuum source (not shown) via a tube 206. The vacuum source is schematically illustrated in FIG. 3. The vacuum source, such as but not limited to a vacuum pump, a vacuum pump in combination with an accumulator, a vacuum pump with air bleed, combinations, thereof, or other device capable of producing a vacuum or partial vacuum within reservoir 212. This vacuum can be varied based upon the particular volume of ink within the reservoir, the properties and characteristics of the ink, the temperature of the ink, desired curvature of the meniscus of the ink at one or more of the nozzles of one or more print heads, to thereby maintain the pressure of the ink within the desired tolerances.

By creating a vacuum or partial vacuum within the reservoir, the column of ink extending from the reservoir to the nozzles of the print heads are "drawn" upwardly away from the nozzles, thereby changing the pressure exerted by the ink at the nozzles of the print heads. This "drawing" effect also allows printing system to control the volume of ink disposed at the print heads and the curvature of the meniscus at each nozzle. Further, changing the level of the vacuum or partial vacuum allows printing system to accommodate a variety of different inks. This is achieved by mitigating the fluid dynamic and chemical properties of the ink and materials forming the reservoir, the tubes, and the print heads through changing the level of the vacuum or partial vacuum to thereby maintain the pressure at the nozzles within a desired level where each meniscus neither ruptures nor extends outwardly from respective nozzles. In accordance with one embodiment of the invention, the pressure can be adjusted based on fluid dynamics of an ink, viscosity of an ink, temperature of an ink, chemical properties of the ink and materials forming the reservoir, the tubes, and the print heads, and/or the temperature of the inks.

Additional components and systems of an exemplary printing system are schematically depicted in FIG. 3. The following description is directed to a single reservoir and one or more print heads. One skilled in the art can understand that a similar discussion can be made for multiple reservoirs and associated multiple print heads.

As shown, printing system 300 includes reservoir 306 that is in fluid communication with print head 350*a*–350*n*, in a similar manner as described above. Reservoir 306 can have a similar configuration to reservoir 312 described above. The reservoir 306 fluidly communicates with a remote main ink reservoir 310 through appropriate tubes or other structures capable of functioning to deliver ink from one reservoir to another reservoir. The main ink reservoir 310 can be any type of container that is capable of storing ink. Consequently, main ink reservoir 310 is one example of structure capable of performing the function of means for remotely storing a fluid.

Main ink reservoir 310 includes an outlet that provides the ink to reservoir 306 as ink is delivered to print heads 350*a*–350*n* before, during, or subsequent to a pass of printer head carnage of the print media during the printing process. As the printing process progresses, i.e., ink is delivered from one or more of print heads 350*a*–350*n* to printable media, the level of ink within reservoir 306 may come close to falling outside of defined tolerance levels. One tolerance level defines a maximum volume of ink to be maintained within reservoir 306, while another tolerance level defines a minimum volume of ink to be maintained within reservoir 306. These tolerance levels can have values that are either the same or different one from another. For instance, in one configuration, if we define a level 314 as a median of a tolerance range, the actual ink level can be maintained within a range of about +/−1 inch. In another configuration, the actual ink level can be maintained within a range of about +/−½ inch. In still another configuration, the actual ink level can be maintained within a range of about +/−⅛ inch from level 314. These tolerances can be maintained during the printing process and/or refilling of reservoir 306.

To maintain the ink level within the above-identified tolerances, ink is delivered to reservoir 312 from main ink reservoir 310 under the command of controller 308, such as one or more mechanical devices, hydraulic devices, pneumatic devices, electrical devices, optical devices, or combinations of such devices. Ink delivery occurs when a sensor 316 within reservoir 306 delivers a signal to controller 308 that indicates the level of ink within reservoir 306. The controller 308 can analyze the signal and determine whether the ink level is outside of tolerance or becoming close to being outside tolerance. Based upon this determination, controller 308 can activate a pump 318, disposed either within main ink reservoir 310 or external to main ink reservoir 310, to force ink into reservoir 306.

In another configuration, sensor 316 can deliver a signal indicating that the level of the ink is becoming close to or currently exceeds a defined tolerance. In response to receiving such a signal, controller 308 can activate pump 318 to force or deliver ink to reservoir 306 to place the level of ink within tolerances.

Therefore, controller 308, whether alone or in combination with one or more of the structures defined herein, such as but not limited to, one or more sensors, sensor devices, control boards, ink reservoirs, and/or ink pumps, is one structure capable of performing the function of means for varying a level of a fluid within a reservoir or container. One skilled in the art can identify a variety of other structures that are capable of performing this desired function.

In addition to receiving signal indicating the level of ink within reservoir 306, controller 308 can communicate with a sensor 320 that is disposed in either accumulator 304 or reservoir 306 to sense the particular a level of the vacuum or partial vacuum therein. The sensor 320 can be a pressure sensor, a precision pressure sensor, or some other sensor capable of detecting the level of vacuum or partial vacuum within reservoir 306 and/or accumulator 304. This sensor 320 is one structure capable of performing the function of means for identifying a level of a vacuum or partial vacuum. One skilled in the art can identify various other configurations of the sensor that are capable of performing the desired function.

Whether sensor 320 identifies a level of a vacuum or partial vacuum within accumulator 304 and/or reservoir 306, controller 308 can utilize the sensed level of the vacuum or partial vacuum either alone or in combination with the sensed level of the ink to identify changes to be made to the level of the vacuum or partial vacuum and corresponding signals to be sent to vacuum pump 302 and/or ink pump 318. Alternatively, controller 308 can utilize the sensed level of the ink alone to identify changes to be made to the level of the vacuum or partial vacuum and thereafter generate signals to be sent to vacuum pump 302 and/or ink pump 318 to change the level of the vacuum or partial vacuum within reservoir 306. Therefore, controller 308, whether alone or in combination with one or more of the structures defined herein, such as but not limited to one or more sensors, sensor devices, control boards, vacuum pumps, and/or accumulators, is one structure capable of performing the function of means for varying the level of the vacuum or partial vacuum within a reservoir.

FIG. 3 also illustrates temperature sensors 372*a*–372*n* that are attached to the print heads 350*a*–350*n*. The sensors 372*a*–372*n* sense the temperature of the respective print heads 350*a*–350*n* to which the sensors are connected. The temperature data generated by the sensors 372*a*–372*n* can be used by the controller 308, either alone or in combination with the other structures defined herein or with data provided by the sensor 316 and the sensor 320, to vary the level of the vacuum or partial vacuum within the reservoir 306.

The vacuum pump 302 is configured to move air from within reservoir 306 and accumulator 304 under the command of controller 308. The vacuum pump 302 can remove air from reservoir 306 and/or accumulator 304, or alternatively, move air from within reservoir 306 to accumulator 304. In the latter case, vacuum pump 302 can create changes in the level of the vacuum or partial vacuum within reservoir 306 by causing air molecules to compress together or allowing air molecules to separate one from another.

Communicating with vacuum pump 302 is accumulator 304. The accumulator 304 aids with creating and changing the level of the vacuum or partial vacuum within reservoir 306. The accumulator 304 is disposed between vacuum pump 302 and reservoir 306 and functions to increase the resolution, the accuracy, and the precision of vacuum pump 302. By providing a large volume of air or other fluid within accumulator 304, the pumping effects of vacuum pump 302 are translated into small, incremental changes in the level of the vacuum or partial vacuum within reservoir 306. Consequently, the combination of vacuum pump 302 and accumulator 304 can maintain the level of the vacuum or partial vacuum within reservoir 306 to achieve the desired pressure of the ink at the nozzles (not shown) of print head 350*a*–305*n*.

The vacuum pump, either alone or in combination with the accumulator, is an exemplary structure capable of performing the function of means for creating a vacuum or partial vacuum within a reservoir. One skilled in the art can identify various other structures that are capable of performing this desired function. Further, the accumulator is one structure capable of performing the function of means for increasing the precision of a vacuum pump. One skilled in the art can identify various other structures that are capable of performing this desired function. For instance, in another configuration, a vacuum pump with a regulated air bleed can function as the vacuum pump.

Illustratively, the deviation from ambient pressure or atmospheric pressure causing the vacuum or partial vacuum in reservoir 306 by vacuum pump 302 and/or accumulator 304 can range from about +/−3 inches of water to about +/−60 inches of water. In another configuration, the deviation from ambient pressure or atmospheric pressure causing the vacuum or partial vacuum within reservoir 306 can range from about +/−1 inch of water to about +/−30 inches of water. In still another configuration, the deviation from ambient pressure or atmospheric pressure causing the vacuum or partial vacuum within reservoir 306 can range from about +/−6 inches of water to about +/−8 inches of water.

By creating a vacuum or partial vacuum within reservoir 306, vacuum pump 302 and/or accumulator 304 reduce the pressure of ink at the nozzles, such pressure being associated with the height difference between the vertical height of the nozzles and the vertical height of the level of ink within reservoir 306 and/or the temperature of the ink, the print heads, or the printing system. Effectively, a pressure differential is created between reservoir 306 and the pressure at the nozzles, the pressure at the nozzles, in one embodiment being substantially the same as ambient or atmospheric pressure. Illustratively, the difference in pressure between reservoir 306 and ambient or atmospheric pressure is small enough that the adhesion properties and surface tension of the ink maintains meniscus as ambient air attempts to move through the nozzles. The pressure difference can be varied to control the pressure of ink at the nozzles. The vacuum pump 302 and/or accumulator 304 can also adjust the pressure of the ink in response to temperature data.

Through controlling the pressure of ink at the nozzles, the potential for excessive or insufficient delivery of ink from the nozzles is reduced. Additionally, by controlling the pressure at the nozzles, the curvature of meniscus is controlled; thereby changing the volume of ink delivered from each the nozzle during a printing process. Further, the system can accommodate inks having differing properties and characteristics, such as but not limited to, adhesion characteristics, attraction characteristics, surface tension, temperature dependent properties, or other properties or characteristics of the ink or fluid. For instance, the system can be used to perform a printing process using a first ink in a first reservoir and subsequently used to print using a second ink in a second reservoir. The system can operate with a particular level of a vacuum or partial vacuum and associated ink levels for the first ink and subsequently operate at another level of a vacuum or partial vacuum based upon the ink level and the characteristics and properties of the second ink. Through changing the level of the vacuum or partial vacuum generated by the pump, alone or in combination with the accumulator, the same system can operate using multiple different inks in an efficient manner. With only one variable being changed, the time and money associated with testing of new ink or inks not previously tested with a particular system or printing device are reduced.

This is an advance over existing systems because large sums of money and time must currently be spent in testing differing inks with differing systems to achieve high quality printer output. When new inks or inks not previously tested with a particular system or printing device are to be used with a particular system or device, the manufacturer of the ink and/or system or device must spend numerous hours and large amounts of money to verify that the system or device can print using the proposed ink. Further, the ink or system/device manufacturer must identify usage parameters specific to the ink and system or device, such parameters taking many hours and large quantities of money to generate. In many cases, the systems and/or devices must also be modified to accommodate the new or proposed ink.

Figure 4:
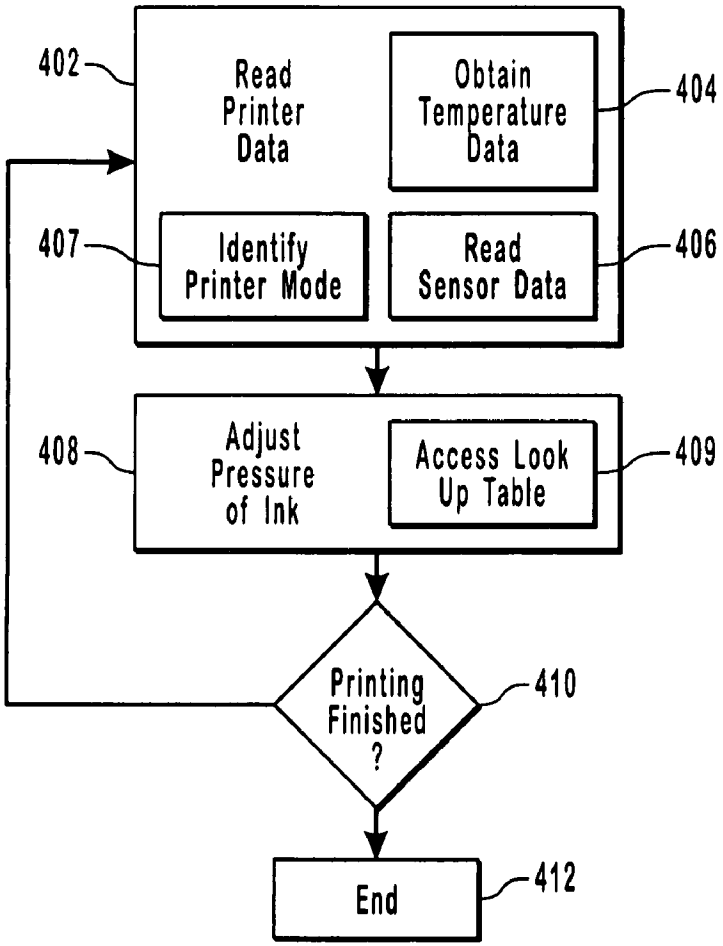
FIG. 4 is a flow diagram of an exemplary method for adjusting the pressure of ink at nozzles of a print head using at least temperature data of the printing system.

FIG. 4 illustrates an example of a flow chart for adjusting or controlling the pressure of ink at the nozzles of a print head. The method begins by reading printer data 402 from each printer. Reading printer data 402 may include, for example, obtaining temperature data 404 from the temperature sensors in the printing system. As previously stated, a change in the temperature of the ink may indicate that, for example, the viscosity of the ink has changed and a different pressure is required to deliver a certain volume of ink through the nozzles. Reading printer data 402 may also include, but is not limited to, identifying a printer mode 407 and reading other sensor data 406, such as the level indicator of the ink reservoir and the pressure present in the ink reservoir.

Next, the printer data is processed and the pressure of the ink is adjusted 408 based on the printer data. The printer data used to adjust the pressure of the ink 408 can include various combinations of temperature data, printer mode data, and other sensor data. To adjust the pressure of the ink, look up tables (or other memory structures/databases) are accessed using the printer data to identify a target pressure. The target pressure retrieved from the look up tables is used to actuate the vacuum pump to adjust the pressure of the ink to the target pressure associated with the printer data. Adjusting the pressure of the ink 408 may therefore include accessing a data store such as a look up table to identify a pressure that is used to adjust the pressure of the ink. If the printing process is finished 410, the method may end 412. If the printing process is not finished, then the printer data is read 402 again and the printer pressure is adjusted accordingly.

Reading the printer data 402 and more particularly reading or obtaining the temperature data 404 can depend on the configuration of the temperature sensors in the printing system. In other words, the method can be adapted to account for different printing system configurations and/or different sensor arrangements. In one configuration, each print head is connected with its own temperature sensor. In addition, the reservoir associated with each print head in this example each has a partial vacuum that is controlled by a separate vacuum pump. In this configuration, the pressure of the ink at the nozzles of each print head can be controlled independently. Each print head, or each color of ink is separately controlled. Thus, the temperature data from each temperature sensor is used to control the pressure of a particular reservoir. Because each print head has a temperature sensor, a temperature sensor that detects the ambient temperature is not typically needed.

In another example, each print head is connected with its own temperature sensor, but there is a single vacuum pump that controls the pressure for all of the reservoirs associated with the print heads. The temperature data from the temperature sensors is typically processed by averaging the temperature data in this case because the temperatures of the print heads likely varies. In another embodiment, the temperature data is weighted to account, for example, for ink color and the like. As with the previous example, a temperature sensor that detects the ambient temperature is not typically needed because each print head has its own temperature sensor.

In another example, less than all of the print heads have a temperature sensor. In this example, a temperature sensor that determines the ambient temperature may be used. The sensor on the print head is typically mounted on the color that is expected to fire the most. The temperature data from this sensor is then averaged with the ambient temperature data to account for the other print heads that do not fire as often and therefore have a lower temperature. Thus, the methods described herein can be adapted to control the pressure of a partial vacuum using different sensor configurations. In each example, the quality of the printed image is typically improved because the volume of ink is being controlled more precisely by controlling the pressure of the ink at the nozzles in response to at least the temperature data collected by the temperature sensors distributed in the printing system.

In each of the foregoing examples, the temperature data is processed. The temperature data is processed based, in part, on the sensor configuration. As previously stated, for example, if a system has a temperature sensor for determining the ambient temperature and a temperature sensor on one of the print heads, the temperature data from the two sensors is averaged. Alternatively, a weighted average may be performed on the temperature data from these two temperature sensors. In other configuration such as when each print head has its own temperature sensor and each print head is associated with a reservoir that has its own vacuum pump, the temperature data does not need to be averaged.

After the temperature data is processed, a look up table is accessed 409 to identify an appropriate pressure and the pressure is adjusted 408 accordingly. Thus, the pressure is adjusted based, in one example, on the average of the temperature data or on the weighted average. In this example, the sensor on the print head is typically mounted on the print head that is expected to fire more than other print heads. Averaging the temperature data at least partially compensates for the temperatures of print heads that are not firing or are not firing as much as the print head with the temperature sensor.

In another embodiment, a temperature sensor is connected with each print head. In this example, the temperature data from a particular sensor on a print head can be used to adjust the pressure of the ink for that print head. If the pressure of more than one print head is controlled from a single vacuum pump, then the temperature data from the temperature sensors for each of the print head can be averaged and the pressure may be adjusted accordingly.

Figure 5:
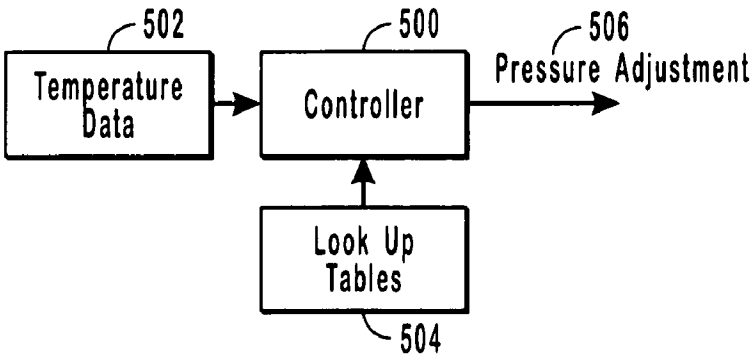
FIG. 5 illustrates an example of a controller that processes temperature data to access a look up table to determine a pressure adjustment based at least on the temperature data.

FIG. 5 illustrates one example of adjusting the pressure based at least on temperature data from the printing system. As described previously, the pressure can be adjusted using other data as well in addition to the temperature data. In FIG. 5, the controller 500 receives temperature data 502 from the temperature sensors. The controller 500 then processes the temperature data 502 as described above. Once the temperature data 502 is processed, the controller 500 accesses the look up tables 504 to identify the appropriate pressure for the temperature data. A pressure adjustment 506 is then performed by the controller, which activates the vacuum pump to adjust the pressure in the ink reservoir(s).

In one embodiment, the controller samples the temperature sensors to obtain temperature data at different rates. Temperature data can be sample, for example, multiple times per second, once every few seconds, and the like. Because the temperature of the print heads can change quickly, the temperature data is sampled at a rate that is fast enough to detect temperature changes.

The look up tables 504 associate temperature data with pressures. For a given temperature or set of temperature data, an appropriate pressure is identified from the look up tables 504 and the pressure of the printing system is adjusted accordingly by the controller. As previously stated, there may be separate look up tables that are specific to ink color, ink type, and the like or any combination thereof. Thus, the look up tables may be accessed based on the temperature data, the ink color, the ink type, and the like.

The information stored in the look up tables can be determined empirically in one embodiment. Generating the look up tables empirically ensures that the pressures in the look up tables account for viscosity of the ink, capillary action of the ink, adhesive properties of the ink, and the like within the tubing and the ink reservoirs.

In one embodiment, there is a look up table for each color and/or each print head of a printing system. In addition, the look up tables 504 can be adjusted to represent pressures for particular nozzles or groups of nozzles. Because the nozzles on a print head are typically designed to deposit the same volume of ink, the look up tables typically contain pressures for print heads. In another embodiment, the look up tables may be expanded to further account for the mode of the printer. For example, the curves represented by the look up tables can be affected by the carriage velocity, the forces experienced by the print heads/ink reservoirs when the carriage reverses direction, and the like. In other words, the requisite pressure can be affected by the pass mode of the printer. In sum, each print head and/or each color of ink may be associated with multiple look up tables. The specific look up table accessed by the controller may be dependent on ink color, printer mode, ink type, and the like or any combination thereof.

Figure 6:
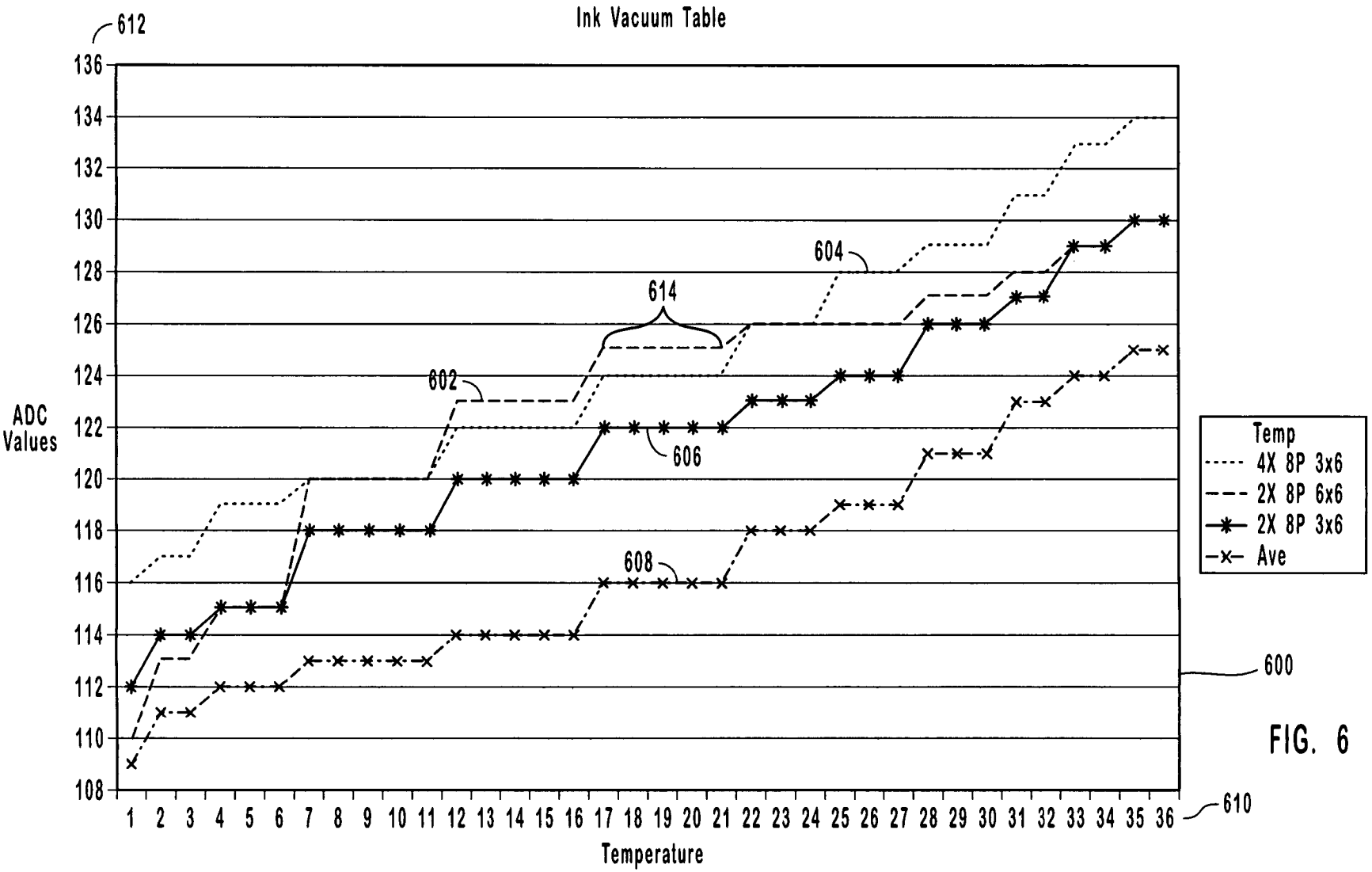
FIG. 6 graphically illustrates data that identifies the appropriate pressures associated with temperatures for different printer modes.

FIG. 6 illustrates one possible graphical representation of the information stored in the look up tables. In this example, the graph has a temperature axis 610 and a pressure axis 612. The plots 602, 604, 606, and 608 represent appropriate pressures for particular temperatures for particular modes of the printing system. Thus, the plot 602 represents the appropriate pressures for temperature data in a first mode, the plot 604, 606, and 608 represent appropriate pressures for temperature data with other printer modes. In general, the appropriate pressure increases as the temperature increases. However, this graph 600 illustrates that a particular pressure is valid across a small range of temperatures. For instance, the portion 614 of the plot 602 corresponds to a temperature range of 3 to 4 degrees. Using these graphs that can be determined empirically, the look up tables can be generated for all colors as a whole or for each color individually.

Embodiments of the invention may include hardware (including processors, memory and the like) and software to perform the methods described herein. The controller 500 is one embodiment of hardware and/or software to perform the methods described herein. The embodiments of the present invention may comprise a special purpose or general purpose computer including various computer hardware, as discussed in greater detail below.

Embodiments within the scope of the present invention also include computer-readable media for carrying or having computer-executable instructions or data structures stored thereon. Such computer-readable media can be any available media which can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer. When information is transferred or provided over a network or another communications connection (either hardwired, wireless, or a combination of hardwired or wireless) to a computer, the computer properly views the connection as a computer-readable medium. Thus, any such connection is properly termed a computer-readable medium. Combinations of the above should also be included within the scope of computer-readable media. Computer-executable instructions comprise, for example, instructions and data which cause a general purpose computer, special purpose computer, or special purpose processing device to perform a certain function or group of functions.

The following discussion is intended to provide a brief, general description of a suitable computing environment in which the invention may be implemented. Although not required, the invention will be described in the general context of computer-executable instructions, such as program modules, being executed by computers in network environments. Generally, program modules include routines, programs, objects, components, data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represent examples of corresponding acts for implementing the functions described in such steps.

Those skilled in the art will appreciate that the invention may be practiced in network computing environments with many types of computer system configurations, including personal computers, hand-held devices, multi-processor systems, microprocessor-based or programmable consumer electronics, network PCs, minicomputers, mainframe computers, and the like. The invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A printing system comprising:

a reservoir having an interior space within which is stored a fluid that is subject to a partial vacuum;

a print head communicating with said interior space, said print head comprising a nozzle adapted to expel a volume of said fluid during a printing process;

a pump communicating with said interior space, said pump adapted to create said partial vacuum within said interior space and change a level of said partial vacuum; and at least one temperature sensor adapted to determine at least a temperature of said print head, wherein said level of said partial vacuum is changed by the pump based on the temperature of said print head.

2. A printing system as defined in claim 1, further comprising an accumulator communicating with said pump and said reservoir.

3. A printing system as defined in claim 1, further comprising a controller, said controller being adapted to control the operation of said pump to change said level of said partial vacuum based on at least the temperature of said print head.

4. A printing system as define in claim 1, further comprising a tube coupled to said reservoir and said print head, said tube being filled with said fluid and delivering said fluid front said reservoir to said print head under the control of said partial vacuum.

5. A printing system as defined in claim 1, further comprising:

a first sensor for identifying a level of said fluid within said interior space, wherein the controller delivers said fluid to said reservoir in response to one or more signals from said first sensor; and a sensor for determining a pressure of said partial vacuum.

6. A printing system as defined in claim 1, further comprising a memory having one or more look up tables stored therein, each look up table storing associated an appropriate pressure with temperature data, wherein the controller accesses at least one look up table based on the temperature of said print head to identify an appropriate pressure for said partial vacuum.

7. A printing system as defined in claim 6, wherein said fluid is an ink.

8. A printing system as defined in claim 7, wherein each look up table is associated with at least one of a mode of the printing system and a color of the ink.

9. A printing system as defined in claim 1, further comprising a second sensor configured to determine an ambient temperature of the printing system.

10. A printing system as defined in claim 9, wherein the ambient temperature and the temperature of the print head are averaged such that said level of said partial vacuum is adjusted based on the average of the ambient temperature and the temperature of the print head.

11. In a printing system that delivers a volume of ink through one or more nozzles on one or more print heads, a method for controlling a pressure of the ink at the one or more nozzles of the one or more print heads, the method comprising:

maintaining a partial vacuum at a reservoir of ink that is in communication with a print head having one or more nozzles, wherein the partial vacuum controls a pressure of the ink at the one or more nozzles;

determining a temperature of the ink at the print head;

accessing a look up table based on at least the temperature of the ink at the print head to identify an appropriate pressure; and changing a pressure of the partial vacuum such that the pressure of ink at the one or more nozzles is within a tolerance of the appropriate pressure obtained from the look up table.

12. A method as defined in claim 11, wherein determining a temperature of the ink at the print head further comprises determining a temperature of inks at other print heads.

13. A method as defined in claim 11, wherein determining a temperature of the ink at the print head further comprises determining an ambient temperature of the printing system.

14. A method as defined in claim 13, further comprising sampling the ambient temperature at a certain frequency.

15. A method as defined in claim 13, wherein accessing a look up table base on at least the temperature of the ink at the print head to identify an appropriate pressure further comprises accessing the look up table based on the ambient temperature.

16. A method as defined in claim 13, wherein accessing a look up table based on at least the temperature of the ink at the print head to identify an appropriate pressure further comprises accessing the look up table based on the an average of the temperature of the ink at the print head and the ambient temperature.

17. A method as defined in claim 11, wherein accessing a look up table based on at least the temperature of the ink at the print head to identify an appropriate pressure further comprises accessing the look up table based on a printing mode of the printing system.

18. A method as defined in claim 11, wherein aceessing a look up table based on at least the temperature of the ink at the print head to identify an appropriate pressure further comprises accessing the look up table based on a color of the ink in the reservoir.

19. A method as defined in claim 11, wherein changing a pressure of the partial vacuum such that the pressure of ink at the one or more nozzles is within a tolerance of the appropriate pressure obtained from the look up table further comprises changing the pressure of the partial vacuum based on a level of ink in the reservoir.

20. A method as defined in claim 11, wherein changing a pressure of the partial vacuum such that the pressure of ink at the one or more nozzles is within a tolerance of the appropriate pressure obtained from the look up table further comprises changing the pressure of the partial vacuum based on a pressure of the partial vacuum.

21. A method as defined in claim 21, wherein determining a temperature of the ink at the print head further comprises sampling the temperature of the ink multiple times in a period of time.

22. A method as defined in claim 21, further comprising sampling the temperature of the ink more than once per second.

23. In a printing system that delivers ink to a media through nozzles on one or more print heads, wherein a volume of ink delivered through the nozzles is related to a pressure of the ink at the nozzles, a method for controlling the pressure of the ink at the nozzles, the method comprising:

identifying a pressure of a partial vacuum of an ink reservoir that provides ink to a print head, wherein a pressure of ink at the nozzles of the print head is controlled by the pressure of the partial vacuum;

obtaining temperature data from at least one of:

a first temperature sensor connected with the print head that determines a temperature for ink in the print head; and a second temperature sensor placed in the printing system that determines an ambient temperature; p1 processing the temperature data at a controller based on a configuration of the first temperature sensor and the second temperature sensor;

accessing at least one look up table based on the temperature data to identify a particular pressure; and changing the pressure of the partial vacuum until the pressure of the ink at the nozzles of the print head is within a tolerance of the particular pressure.

24. A method as defined in claim 23, wherein processing the temperature data at a controller based on a configuration of the first temperature sensor and the second temperature sensor further comprises averaging the temperature for ink in the print head and the ambient temperature.

25. A method as defined in claim 23, wherein obtaining temperature data further comprises obtaining temperature data from other temperature sensors connected with other print heads of the printing system.

26. A method as defined in claim 23, wherein accessing a look up table based on the temperature data to identify a particular pressure further comprises one or more of:

accessing the look up table based on mode of the printing system;

accessing the look up table based on a color of the ink; and accessing the look up table based on a type of ink.

27. A method as defined in claim 23, further comprising sampling the first temperature sensor at a certain frequency and sampling the second temperature sensor at the certain frequency.

28. A method as defined in claim 23, further comprising generating the at least one look up table empirically.

29. A method as defined in claim 23, wherein changing the pressure of the partial vacuum until the pressure of the ink at the nozzles of the print head is within a tolerance of the particular pressure further comprises changing the pressure of the partial vacuum based on a level of ink in the ink reservoir.

30. A method as defined in claim 23, wherein changing the pressure of the partial vacuum until the pressure of the ink at the nozzles of the print head is within a tolerance of the particular pressure further comprises activating a vacuum pump that changes the partial vacuum through an accumulator.

31. A method as defined in claim 23, further comprising continuing to adjust the partial vacuum based on new temperature data obtained from at least one of the first temperature sensor and the second temperature sensor.

32. A printing system comprising:

an ink reservoir in communication with a print head, the ink reservoir having an interior space partially filled with ink;

a pump communicating with the interior space of the ink reservoir; and a controller that receives temperature data including at least one of a print head temperature and an ambient temperature and that causes the pump to change a partial vacuum within the interior space to a desired vacuum pressure level based at least on the temperature data.

33. A printing system as defined in claim 32, further comprising:

at least one temperature sensor adapted to determine a temperature of the print head;

a pressure sensor for determining a pressure of said partial vacuum;

a level sensor for determining a level of said ink in said ink reservoir; and wherein said controller receives temperature data from the at least one temperature sensor, pressure data from the pressure sensor, and level data from said level data, said controller using the temperature data, the pressure data, and the level data to change the partial vacuum to the desired vacuum pressure level.

34. A printing system as defined in claim 32, further comprising a memory having one or more look up tables stored therein, wherein the controller accesses the one or more look up tables based on at least the temperature data to identify the desired vacuum pressure.

* * * * *

UNITED STATES PATENT AND TRADEMARK OFFICE

CERTIFICATE OF CORRECTION

PATENT NO. : 7,040,729 B2
APPLICATION NO. : 10/778728
DATED : May 9, 2006
INVENTOR(S) : Richards It is certified that error appears in the above-identified patent and that said Letters Patent is hereby corrected as shown below:

Column 7
Line 10, change “218” to --216--
Line 29, after “FIG. 2”, insert --.--

Column 11
Line 7, change “312” to --212--
Line 38, change “312” to --306--

Column 12
Line 62, change “305n” to --350n--

Column 14
Line 37, after “table”, insert --409--

Column 19
Line 56, remove “p1”

Signed and Sealed this

Nineteenth Day of June, 2007

JON W. DUDAS
*Director of the United States Patent and Trademark Office*